US010615532B2

(12) United States Patent
Miyamura et al.

(10) Patent No.: US 10,615,532 B2
(45) Date of Patent: Apr. 7, 2020

(54) CONNECTOR WITH A STRUCTURE FOR MOUNTING A TERMINAL UNIT INTO A HOUSING

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Tetsuya Miyamura, Mie (JP); Masaaki Tabata, Mie (JP); Yasuo Omori, Mie (JP); Hajime Matsui, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/308,899

(22) PCT Filed: May 25, 2017

(86) PCT No.: PCT/JP2017/019510
§ 371 (c)(1),
(2) Date: Dec. 11, 2018

(87) PCT Pub. No.: WO2017/217205
PCT Pub. Date: Dec. 21, 2017

(65) Prior Publication Data

US 2019/0157792 A1 May 23, 2019

(30) Foreign Application Priority Data

Jun. 15, 2016 (JP) ..... 2016-118630

(51) Int. Cl.
*H01R 13/42* (2006.01)
*H01R 13/514* (2006.01)
(Continued)

(52) U.S. Cl.
CPC ..... *H01R 13/42* (2013.01); *H01R 12/7005* (2013.01); *H01R 13/502* (2013.01); *H01R 13/514* (2013.01); *H01R 13/639* (2013.01)

(58) Field of Classification Search
CPC .... H01R 13/42; H01R 13/639; H01R 13/502; H01R 12/7005; H01R 13/514; H01R 13/4362; H01R 9/2416; H01R 13/516
(Continued)

(56) References Cited

U.S. PATENT DOCUMENTS 6,638,108 B2 * 10/2003 Tachi ..... H01R 13/4223 439/540.1
7,059,916 B2 * 6/2006 Nishide ..... H01R 13/516 439/686
(Continued)

FOREIGN PATENT DOCUMENTS

JP 2003-249311 9/2003
JP 2004-55470 2/2004
(Continued)

OTHER PUBLICATIONS

International Search Report dated Jul. 25, 2017.

*Primary Examiner* — Travis S Chambers
(74) *Attorney, Agent, or Firm* — Gerald E. Hespos; Michael J. Porco; Matthew T. Hespos

(57) ABSTRACT

It is aimed to simplify the shape of a terminal unit in a structure for mounting the terminal unit into a housing. A connector includes a housing (10) formed with an accommodating portion (11) inside, a guide groove (13) formed in the accommodating portion (11), a terminal unit (30) con-
(Continued)

figured by accommodating a plurality of terminal fittings (49) into a terminal holding member (31) and to be inserted into the accommodating portion (11), a guide rib (46) formed on the terminal unit (30) and configured to guide the terminal unit (30) by sliding in contact with the guide groove (13), and a retainer (20) configured to restrict outward detachment of the terminal unit (30) from the accommodating portion (11) by being mounted into the housing (10) and locking the guide rib (46).

3 Claims, 12 Drawing Sheets

(51) Int. Cl.

| | |
|---|---|
| ***H01R 12/70*** | (2011.01) |
| ***H01R 13/502*** | (2006.01) |
| ***H01R 13/639*** | (2006.01) |

(58) Field of Classification Search
USPC ..... 439/752, 752.5, 695, 686, 598
See application file for complete search history.

(56) References Cited

U.S. PATENT DOCUMENTS

| | | | | |
|---|---|---|---|---|
| 7,661,999 | B2 * | 2/2010 | Horiuchi | H01R 13/4362 439/595 |
| 2004/0132333 | A1 * | 7/2004 | Nakamura | H01R 13/641 439/489 |

FOREIGN PATENT DOCUMENTS

| | | |
|---|---|---|
| JP | 3974695 | 9/2007 |
| JP | 5381602 | 1/2014 |

* cited by examiner

CONNECTOR WITH A STRUCTURE FOR MOUNTING A TERMINAL UNIT INTO A HOUSING

BACKGROUND

Field of the Invention

The present invention relates to a connector.

Related Art

Japanese Unexamined Patent Publication No. 2004-055470 describes a connector used in an in-vehicle LAN (Local Area Network). A wiring harness for in-vehicle LAN is configured by bundling communication wires constituting a twisted pair cable as a noise countermeasure and a power supply wire for supplying power to a device, such as a car navigation system. Terminal fittings fixed to end parts of these wires are inserted into terminal accommodation chambers in a housing. The inserted terminal fittings are held retained by a locking action of a retainer mounted into the housing.

The retainer is left at a partial locking position with respect to the housing before the terminal fittings are inserted into the housing. The retainer at the partial locking position does not interfere with the terminal fittings in an inserting process. The retainer at the partial locking position is pushed into the housing after all of the terminal fittings have been inserted into the housing. In this way, the retainer moves to a full locking position for retaining the terminal fittings.

The terminal fittings connected to two communication wires constituting the twisted pair cable are inserted individually into the terminal accommodation chambers. Thus, end parts of the communication wires are untwisted to ensure an extra length at the time of individual insertion. However, a noise countermeasure function is lost in an untwisted area.

As a measure against this, it is considered to configure a terminal unit by mounting the two terminal fittings connected to the two communication wires into a terminal holding member that has a halved structure and that is separate from the housing. The halved structure enables the terminal fittings to be mounted into the terminal holding member in a direction intersecting a longitudinal direction of the communication wires. Thus, the communication wires need not be untwisted and a reduction of the noise countermeasure function can be avoided.

In this case, a configuration for locking the retainer mounted in the housing to the terminal holding member has been considered as a means for holding the terminal unit in a mounted state. However, the incorporation of a locking structure into the terminal holding member complicates the shape of the terminal holding member.

The invention was completed on the basis of the above situation and aims to simplify the shape of a terminal unit in a structure for mounting the terminal unit into a housing.

SUMMARY

The invention is directed to a connector with a housing formed with an accommodating portion inside, and a guide groove is formed in the accommodating portion. The connector further includes a terminal unit configured by accommodating terminal fittings into a terminal holding member. The terminal unit is configured to be inserted into the accommodating portion. A guide rib is formed on an outer surface of the terminal unit and is configured to guide the terminal unit in an inserting process into the accommodating portion by fitting to and sliding in contact with the guide groove. A retainer is configured to restrict outward detachment of the terminal unit from the accommodating portion by being mounted into the housing and locking the guide rib.

The guide rib is a guide means when mounting the terminal unit into the accommodating portion of the housing and also exhibits a function as a detachment restricting means by being locked to the retainer. Accordingly, the guide rib functions both as the guide means and the detachment restricting means. Thus, the shape of the terminal unit can be simplified as compared to the case where a dedicated locking means to the retainer is formed separately from the guide rib.

An auxiliary rib may be formed at a position behind the guide rib in an inserting direction of the terminal unit on an outer surface of the terminal holding member. The auxiliary rib is capable of sliding in contact with the guide groove. According to this configuration, the guide rib and the auxiliary rib are spaced apart in the inserting direction of the terminal unit slide in contact with the guide groove. Thus, the posture of the terminal unit is stabilized.

A front stop wall may be formed on a front end part of the accommodating portion and constitutes a front end surface of the housing. A butting portion is formed on the terminal unit and is configured to contact the front stop wall when the terminal unit is inserted properly into the accommodating portion. A window may be formed in the front stop wall and may be configured such that a front end part of the terminal unit is fit therein with the butting portion held in contact with the front stop wall. According to this configuration, the front end of the terminal unit is in front of the rear surface of the front stop wall. Thus, the accommodating portion can be made shorter as compared to the case where the front end of the terminal unit is in contact with the rear surface of the front stop wall.

A front end surface of the terminal unit may be positioned to be substantially flush with the front end surface of the housing with the terminal unit properly inserted in the accommodating portion. According to this configuration, a mounted state of the terminal unit in the accommodating portion can be detected by seeing a positional relationship of the front end surface of the terminal unit with the front end surface of the housing.

DETAILED DESCRIPTION

Figure 1:
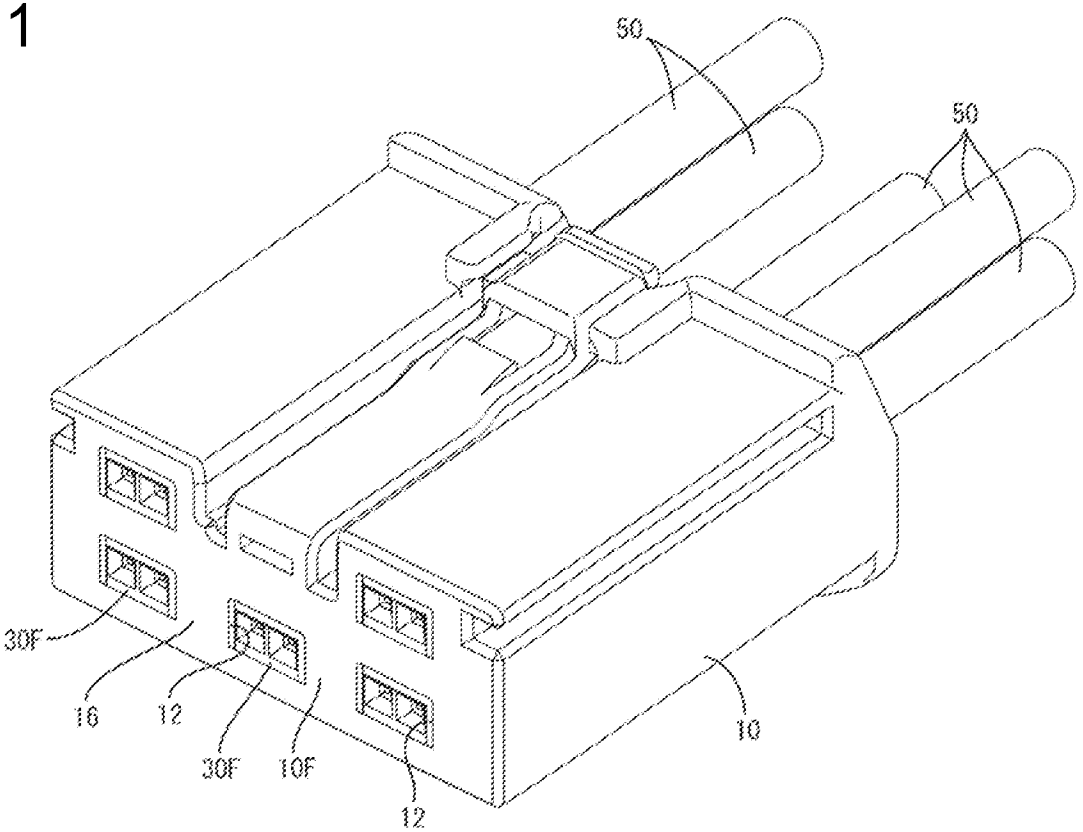
FIG. 1 is a perspective view of a connector of one embodiment.
Figure 2:
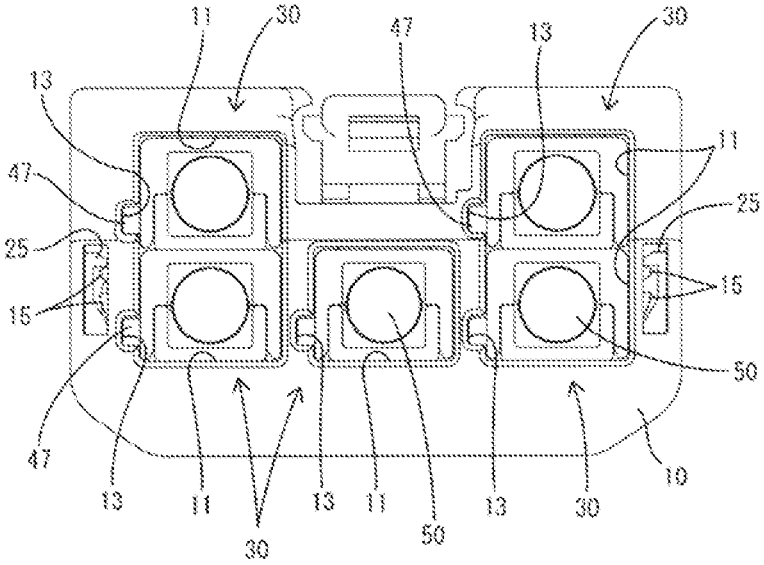
FIG. 2 is a back view of the connector showing a state where a retainer is at a full locking position.
Figure 3:
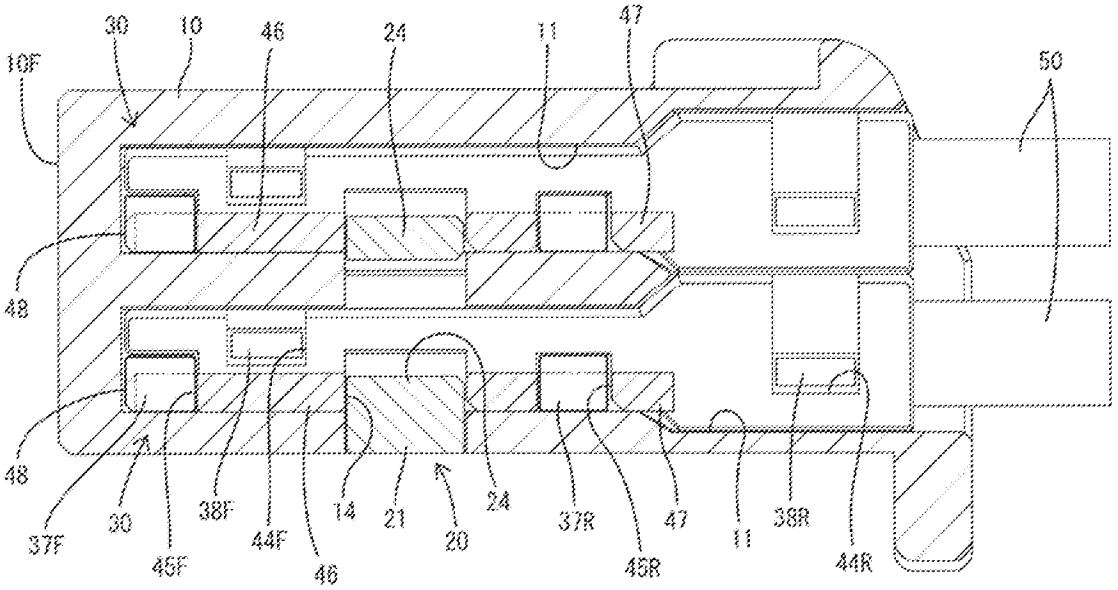
FIG. 3 is a section along X-X of FIG. 2.
Figure 4:
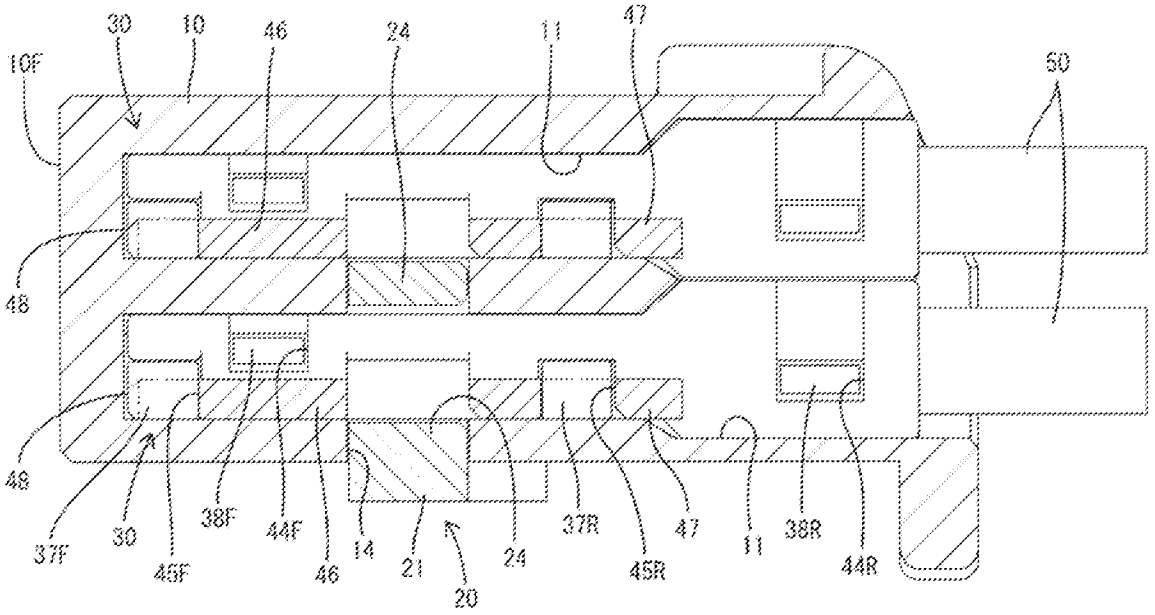
FIG. 4 is a section along X-X in a state where the retainer is at the full locking position.
Figure 5:
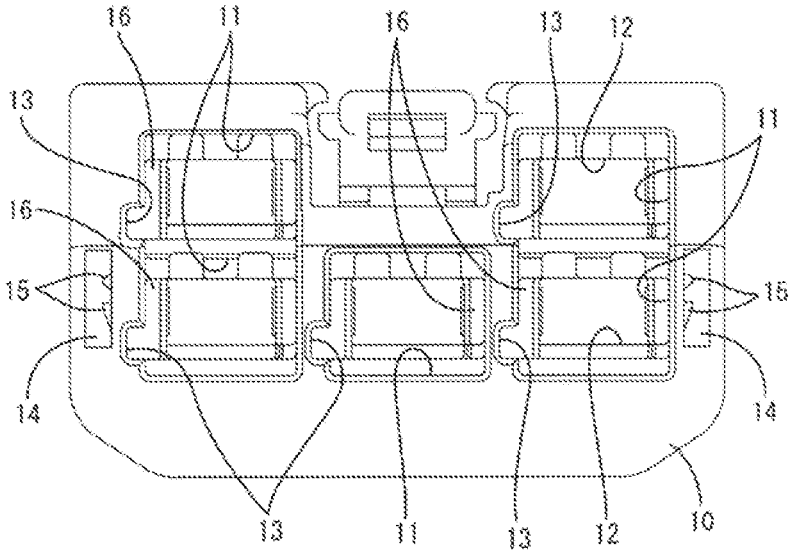
FIG. 5 is a back view of a housing.
Figure 6:
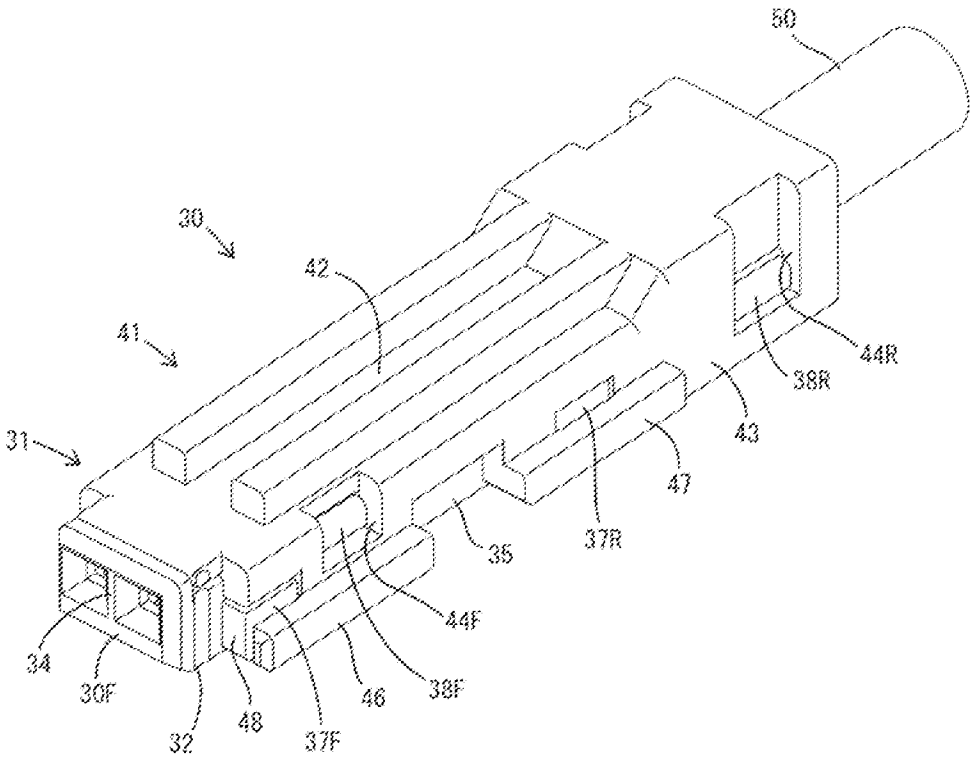
FIG. 6 is a perspective view of a terminal unit.
Figure 7:
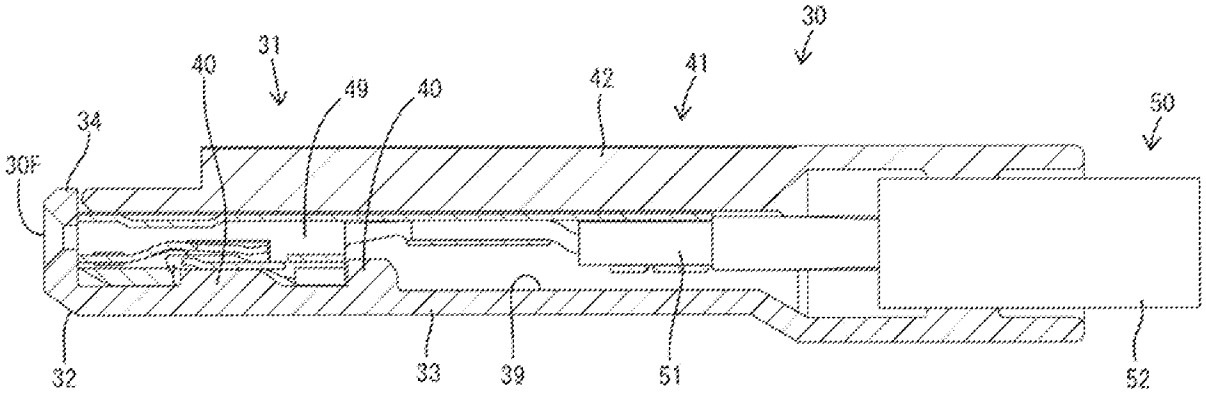
FIG. 7 is a left side view of the terminal unit.

One specific embodiment of the invention is described with reference to FIGS. 1 to 12. Note that, in the following description, a left side in FIGS. 3, 4 and 7 is defined as a front concerning a front-rear direction. Upper and lower sides shown in FIGS. 1 to 12 are defined as upper and lower sides concerning a vertical direction. Left and right sides shown in back views of FIGS. 2 and 5 are defined as left and right sides concerning a lateral direction. Thus, the left and right sides are inverted in FIGS. 10 to 12.

A connector of this embodiment includes a housing 10 made of synthetic resin, one retainer 20 made of synthetic resin and terminal units 30 (five in this embodiment).

The housing 10 is in the form of a block. As shown in FIGS. 2 to 5, accommodating portions 11 (five in this embodiment) are formed inside the housing 10 and are long in the front rear direction. Each accommodating portion 11 has a substantially rectangular cross-sectional shape. The accommodating portions 11 are arranged in upper and lower separate stages, with three accommodating portions 11 disposed laterally (in a width direction) side by side in the lower stage and two accommodating portions 11 arranged right above the accommodating portions 11 on both left and right sides in the lower stage.

The rear end of the accommodating portion 11 is open as an insertion opening in the rear end surface of the housing 10. A front stop wall 16 is formed on front end parts of the accommodating portions 11. The front stop wall 16 constitutes a front end surface 1OF of the housing 10. The front stop wall 16 is formed with penetrating windows 12 for each accommodating portion 11. A width of each window 12 is smaller than that of the accommodating portion 11 and the window hole 12 is disposed in a widthwise center of the accommodating portion 11.

As shown in FIGS. 2 and 5, a guide groove 13 extends linearly in the front-rear direction in the left inner side surface of each accommodating portion 11. Each guide groove 13 is formed continuously over the entire length of the accommodating portion 11 in the front-rear direction. A guide rib 46 and an auxiliary rib 47 of the terminal unit 30 fit to and slide in contact with the guide groove 13.

As shown in FIGS. 3 and 4, a mounting space 14 is formed inside the housing 10 and is open in a lower surface. The mounting space 14 communicate with all of the accommodating portions 11. The retainer 20 is accommodated into the mounting space 14. As shown in FIGS. 2 and 5, locking projections 15 are formed in left and right end edges of the mounting space 14 for selectively locking the retainer 20 at a partial locking position and a full locking position.

Figure 10:
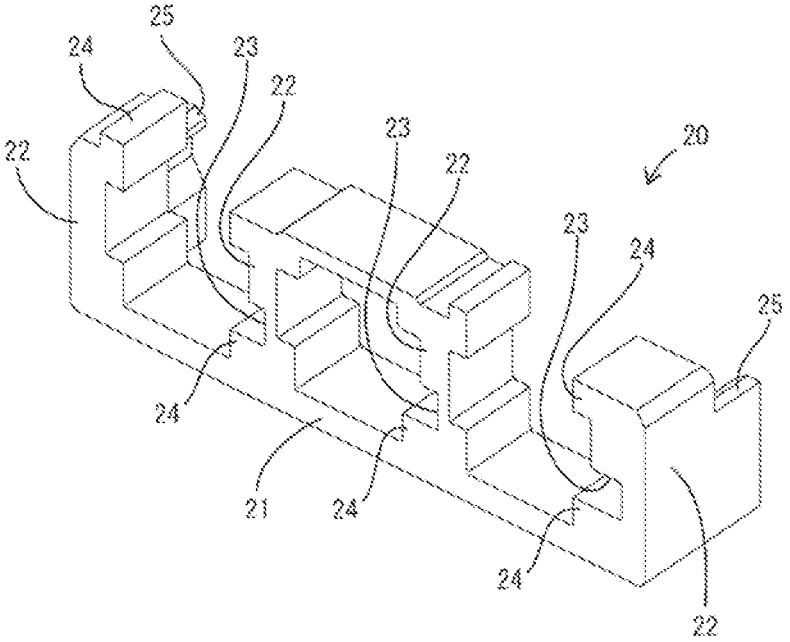
FIG. 10 is a perspective view of the retainer.
Figure 11:
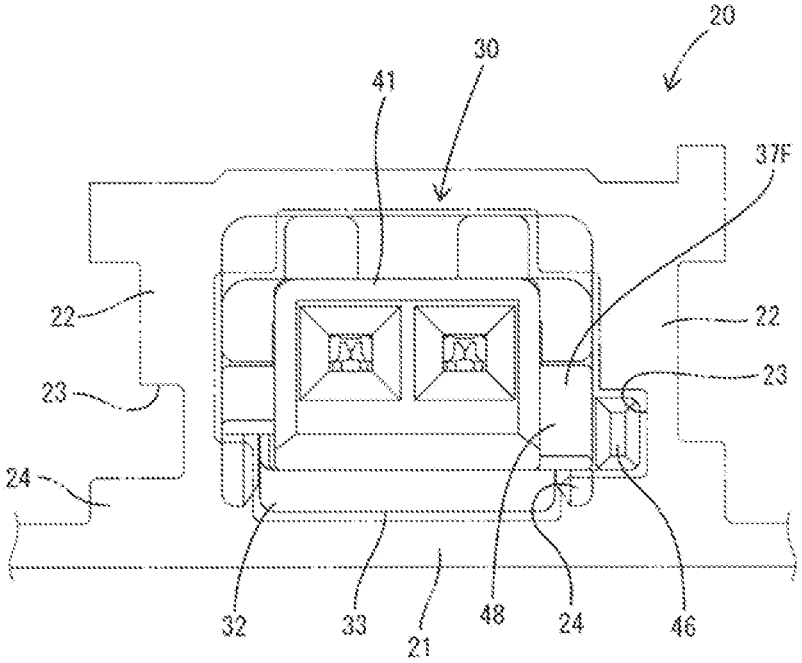
FIG. 11 is a front view showing a positional relationship of the retainer and the terminal unit when the retainer is at a partial locking position.
Figure 12:
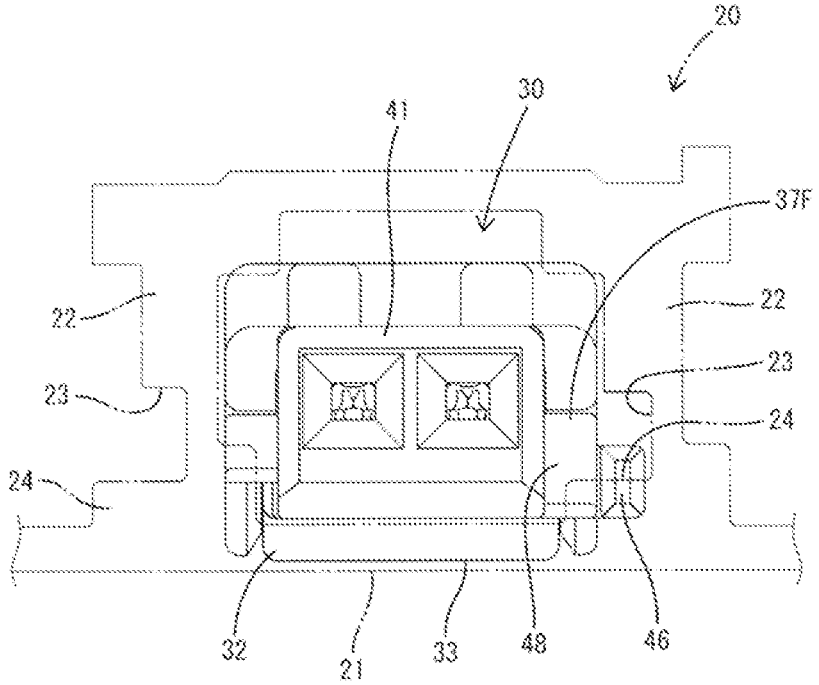
FIG. 12 is a front view showing a positional relationship of the retainer and the terminal unit when the retainer is at the full locking position.

As shown in FIG. 10, the retainer 20 is a single component with a base 21 that is long in the lateral direction and four rising portions 22 rising from the base 21. An escaping recess 23 is formed in the right side surface of each of three rising portions 22 on a left side. Further, a retaining portion 24 is formed on a lower edge part of the escaping recess 23 in the right side surface of each of the three rising portions 22 on the left side. Further, a retaining portion 24 similar to the one on the right side surface is formed on an upper end part of each of the three rising portions 22 on the left side. Furthermore, a plate-like locking claw 25 is formed on each of two rising portions 22 located on both left and right ends.

The retainer 20 is held at the partial locking position by locking the locking claws 25 to the locking projections 15. With the retainer 20 held at the partial locking position, three spaces between adjacent rising portions 22 are located to correspond to the three accommodating portions 11 in the lower stage in the vertical and lateral directions (directions intersecting an inserting direction of the terminal units 30 into the accommodating portions 11) and three escaping recesses 23 are located to correspond to three guide grooves 13 in the lower stage in the vertical and lateral directions.

Three retaining portions 24 constituting the lower edges of the escaping recesses 23 are below and adjacent to the three guide grooves 13 in the lower stage. Two retaining portions 24 formed on the upper end parts of the rising portions 22 are located below and adjacent to two guide grooves 13 in the upper stage.

The retainer 20 is held at the full locking position slightly above the partial locking position by locking the locking claws 25 with the locking projections 15 (see FIG. 2). With the retainer 20 held at the full locking position, the three escaping recesses 23 are located at positions retracted up from the three guide grooves 13 in the lower stage in the vertical and lateral directions. The three retaining portions 24 constituting the lower edges of the escaping recesses 23 overlap the three guide grooves 13 of the lower stage in the vertical direction. The two retaining portions 24 on the upper end parts of the rising portions 22 overlap the two guide grooves 13 of the upper stage in the vertical direction.

The terminal unit 30 includes a terminal holding member 31 made of synthetic resin and two terminal fittings 49 and is connected to a front end part of a twisted pair cable 50. As shown in FIG. 6, the terminal unit 30 is long and narrow in the front-rear direction as a whole and is inserted into the accommodating portion 11 from behind the housing 10. The terminal holding member 31 is configured by vertically uniting and assembling a lower case 32 and an upper case 41. An assembling direction of the cases 32, 41 intersects a longitudinal direction (axial direction) of the twisted pair cable 50.

Figure 8:
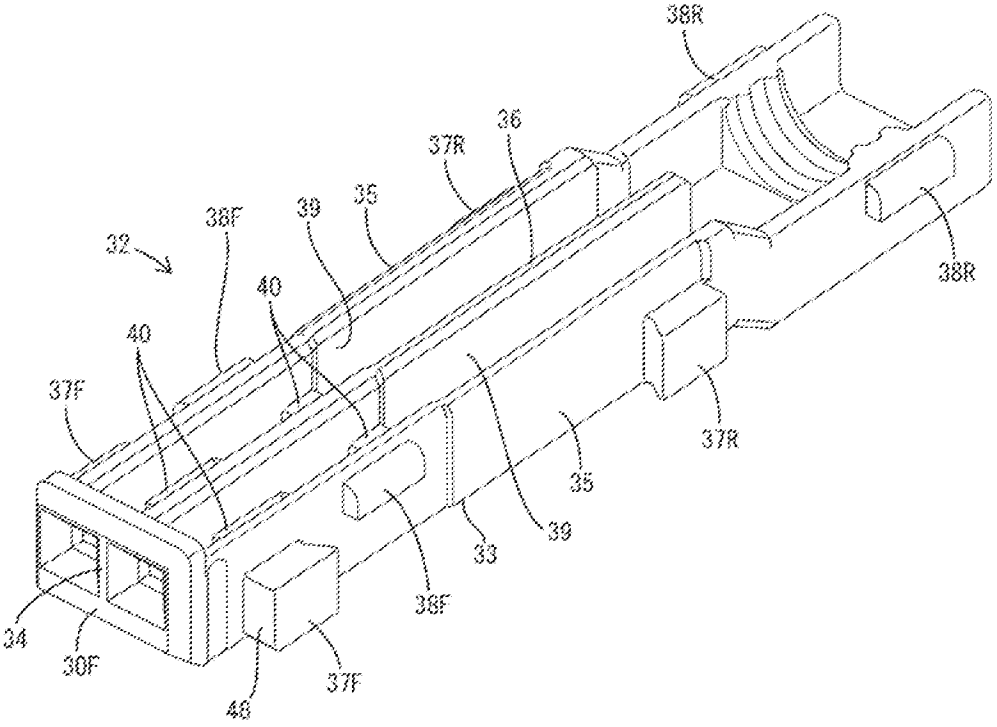
FIG. 8 is a perspective view of a lower case.

As shown in FIG. 8, the lower case 32 includes a bottom wall 33 extending in the front-rear direction, a front wall 34 rising up from the front end of the bottom wall 33, two outer side walls 35 rising up from both left and right sides of the bottom wall 33 and an intermediate wall 36 rising up from a widthwise center of the bottom wall 33.

Two pairs of bilaterally symmetrical hooks 37F, 37R are formed are formed on the outer surfaces of the left and right outer side walls 35 and are spaced apart in the front-rear direction and two pairs of bilaterally symmetrical lock projections 38F, 38R are formed while being spaced apart in the front-rear direction. The front hooks 37F are disposed on front end parts of the outer side walls 35. The front lock projections 38F are disposed behind the front hooks 37F, the rear hooks 37R are disposed behind the front lock projections 38F and the rear lock projections 38R are disposed on rear end parts of the outer side walls 35.

The lower case 33 is formed with two bilaterally symmetrical terminal accommodation grooves 39 defined by the bottom wall 33, the left and right outer side walls 35 and the intermediate wall 36. As shown in FIG. 7, two front and rear retaining projections 40 are formed on the bottom wall 33 to project into the terminal accommodation grooves 39. The terminal fittings 49 are accommodated respectively into each terminal accommodation groove 39. The terminal fitting 49 is held with rearward detachment restricted by a locking action of the two retaining projections 40.

Two terminal fittings 49 are connected individually to front end parts of two wires 51. The two wires 51 are used as communication wires 51 (signal wires), and constitute the twisted pair cable 50 having a noise reduction function by being spirally twisted. In an area of the twisted pair cable 50 excluding a front end part, the two wires 51 are surrounded collectively by a sheath 52. A front end part of the sheath 52 also is accommodated in rear end parts of the terminal accommodation grooves 39. The two wires 51 are drawn out from one terminal unit 30 and put together as the twisted pair cable 50 by the sheath 52. Thus, one twisted pair cable 50 can be regarded as a sub-harness constituted by the two wires 51.

The terminal fitting 49 is mounted into the terminal accommodation groove 39 from above the lower case 32. This mounting direction of the terminal fitting 49 is a direction intersecting the longitudinal direction of the twisted pair cable 50. Thus, the wires 51 need to be exposed only by a length necessary to crimp the terminal fittings 49 and the wires 51 by a crimping machine (applicator) by removing the sheath 52 in the front end part of the twisted pair cable 50.

Figure 9:
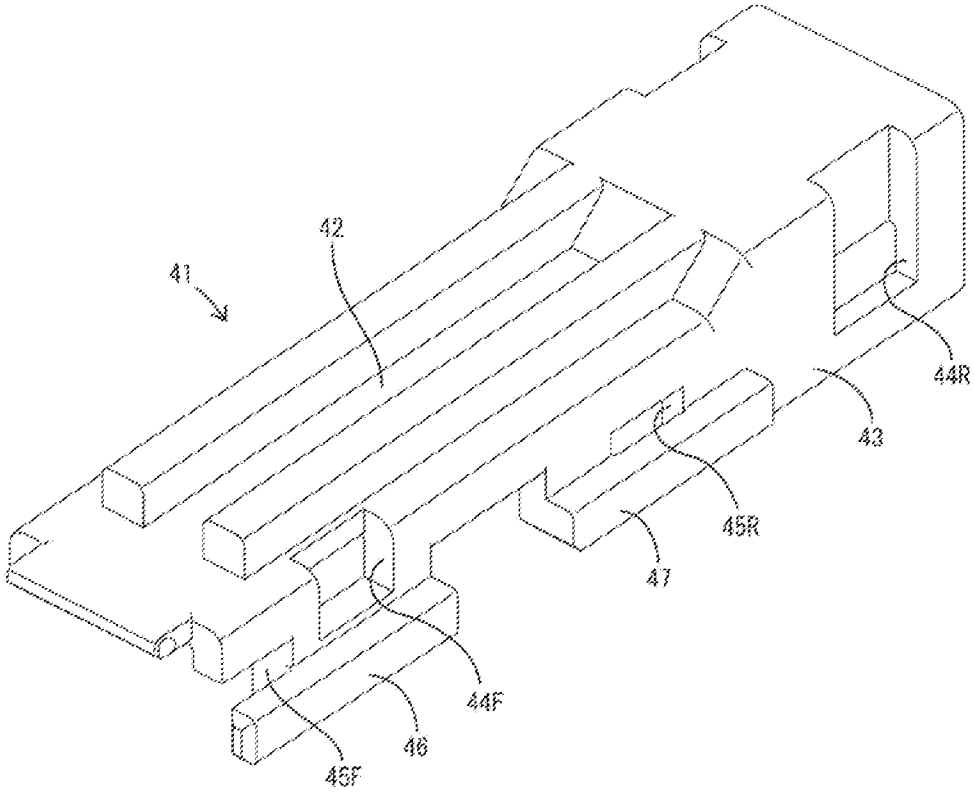
FIG. 9 is a perspective view of an upper case.

As shown in FIG. 9, the upper case 41 includes an upper wall 42 and two side walls 43 extending downward from both left and right side edges of the upper wall portion 42. Two pairs of lock holes 44F, 44R to be locked to the lock projections 38F, 38R of the lower case 32 are arranged on the both left and right side wall portions 43 while being spaced apart in the front-rear direction. Similarly, two pairs of bilaterally symmetrical receiving portions 45F, 45R are arranged on the both left and right side walls 43 while being spaced apart in the front-rear direction. The hooks 37F, 37R of the lower case 32 contact the receiving portions 45F, 45R from the front.

A guide rib 46 and an auxiliary rib 47 project from the outer side surface of the left side wall 43 of the upper case 41. The guide rib 46 and the auxiliary rib 47 extend in the front-rear direction at the same height. The guide rib 46 is in a front area of the side wall 43 and the auxiliary rib 47 is in an area behind the guide rib 46. The front receiving portion 45F is in a formation area range of the guide rib 46 in the front-rear direction, i.e. at a position close to the guide rib 46 and the rear receiving portion 45R is in a formation area range of the auxiliary rib 47 in the front-rear direction, i.e. at a position close to the auxiliary rib 47.

With the upper case 41 united and assembled with the lower case 32 having the terminal fittings 49 accommodated therein, the lock projections 38F, 38R of the lower case 32 and the lock holes 44F, 44R of the upper case 41 are locked, thereby locking the cases 32, 41 in an assembled state. Upper surface openings of the terminal accommodation grooves 39 are closed by the upper wall 42 with the cases 32, 41 assembled. Thus, the terminal fittings 49 do not come out of the terminal accommodation grooves 39.

The left and right front hooks 37F project out from left and right outer side surfaces of the terminal holding member 31, and the front surfaces thereof function as butting portions 48 facing forward. The front surface of the left butting portion 48 and the front end surface of the guide rib 46 are substantially flush with and adjacent to each other.

Next, an assembling procedure of the connector is described. First, the retainer 20 is assembled with the housing 10 and held at the partial locking position. At this time, the retaining portions 24 of the retainer 20 are located below the guide grooves 13. In this state, the terminal unit 30 is inserted into each accommodating portion 11. In an initial stage of an inserting process, the guide rib 46 fits to and slides in contact with the guide groove 13. This sliding contact stabilizes the position of the terminal unit 30 in the vertical direction with respect to the housing 10 and the posture thereof is stabilized not to incline in the front-rear direction and the lateral direction with respect to the housing 10.

As the insertion proceeds, the guide rib 46 passes through the escaping recess 23 without interfering with the retainer 20 (retaining portion 24). Since the auxiliary rib 47 also fits to and slides in contact with the guide groove 13 during this time, the position and posture of the terminal unit 30 with respect to the housing 10 are stabilized further. When the terminal unit 30 reaches a proper insertion position, the butting portions 48 contact the rear surface of the front stop wall 16, thereby restricting any further insertion of the terminal unit 30. Further, the front part of the terminal unit 30 is fit into the window hole 12 and a front end surface 30F of the terminal unit 30 and the front end surface 10F of the housing 10 are positioned to be continuous and flush with each other.

When the insertion of all the terminal units 30 is completed, the retainer 20 at the partial locking position is pushed to move to the full locking position. At this time, if there is any terminal unit 30 incompletely inserted, the retaining portion 24 of the retainer 20 interferes with the guide rib 46 of the incompletely inserted terminal unit 30. Thus, the retainer 20 cannot be pushed to the full locking position. If all the terminal units 30 are properly inserted, the retainer 20 can be moved to the full locking position.

When the retainer 20 moves to the full locking position, the retaining portions 24 are located at the same heights as the guide ribs 46 in the vertical direction and the front surfaces of the retaining portions 24 are located to proximately face the rear end surfaces of the guide ribs 46. In this state, even if the terminal unit 30 is pulled rearward, the guide rib 46 is locked to the retaining portion 24. Thus, the terminal unit 30 stays in the accommodating portion 11 without moving rearward and is held mounted in the housing 10.

Note that if the twisted pair cable 50 is pulled behind the housing 10 (terminal unit 30), a pulling force is transferred to the lower case 32 via the terminal fittings 49 and the retaining projections 40 and further transferred to the guide rib 46 of the upper case 41 via the hooks 37F, 37R and the receiving portions 45F, 45R. Since the front receiving portion 45F and the guide rib 46 are located proximate to each other, there is no possibility that the upper case 41 is deformed improperly.

As described above, the connector of this embodiment includes the housing 10 formed with the accommodating portions 11 inside and the terminal units 30 each configured such that the terminal fittings 49 are accommodated in the terminal holding member 31. The terminal unit 30 is inserted into the accommodating portion 11, and the inserted terminal unit 30 is retained by the retainer 20. The accommodating portion 11 is formed with the guide groove 13, and the guide rib 46 is formed on the outer surface of the terminal unit 30. In the process of inserting the terminal unit 30 into the accommodating portion 11, the guide rib 46 fits to and slides in contact with the guide groove 13. Thus, the terminal unit 30 is guided and the position and posture of the terminal unit 30 with respect to the housing 10 are stabilized.

The retainer 20 is mounted into the housing 10 to lock the guide ribs 46 and to restrict outward detachment of the terminal units 30 from the accommodating portions 11. The guide rib 46 functions to guide the mounting of the terminal unit 30 into the accommodating portion 11 of the housing 10 and also exhibits a function as a detachment restricting means by being locked to the retainer 20. Since the guide rib 46 has both a function as the guide means and a function as the detachment restricting means, the shape of the terminal unit 30 can be simplified as compared to the case where a dedicated locking means to the retainer 20 is formed separately from the guide rib 46.

The auxiliary rib 47 is formed on the outer surface of the terminal holding member 31 at the position behind the guide rib 46 in the inserting direction of the terminal unit 30 and can slide in contact with the guide groove 13. According to this configuration, the guide rib 46 and the auxiliary rib 47 are spaced apart in the inserting direction of the terminal unit 30 and slide in contact with the guide groove 13 to stabilize the posture of the terminal unit 30.

The front stop wall 16 is at the front end 10F of the housing 10 and is formed on the front end parts of the accommodating portions 11. Additionally, the terminal unit 30 is formed with the butting portions 48 configured to contact the front stop wall 16 when the terminal unit 30 is inserted properly into the accommodating portion 11. The front stop wall 16 is formed with the windows 12 into which the front end parts of the terminal units 30 are fit with the butting portions 48 held in contact with the front stop wall 16. According to this configuration, the front ends of the terminal units 30 are in front of the rear surface of the front stop wall 16. Thus, the accommodating portions 11 can be made shorter as compared to the case where the front ends of the terminal units 30 are in contact with the rear surface of the front stop wall 16.

Further, with the terminal unit 30 accommodated in the accommodating portion 11, the front end surface 30F of the terminal unit 30 is substantially flush with the front end surface 10F of the housing 10. According to this configuration, the mounted state of the terminal unit 30 in the accommodating portion 11 can be detected by seeing a positional relationship of the front end surface 30F of the terminal unit 30 with the front end surface 10F of the housing 10.

The invention is not limited to the above described and illustrated embodiment. For example, the following embodiments also are included in the scope of the invention.

Although the retainer is locked only to the terminal holding members in the above embodiment, the retainer may be locked to both the terminal holding members and the terminal fittings.

Although the auxiliary rib is formed behind the guide rib in the above embodiment, the auxiliary rib may not be formed.

The front end surface of the terminal unit is positioned to be substantially flush with the front end surface of the housing when the terminal unit is inserted properly into accommodating portion in the above embodiment. However, the front end surface of the terminal unit may be located behind the front end surface of the housing when the terminal unit is inserted properly into the accommodating portion.

Although the front part of the terminal unit is fit into the window of the front stop wall in the above embodiment, the front end of the terminal unit may come into contact with the rear surface of the front stop wall.

Two terminal fittings are mounted in one terminal holding member in the above embodiment. However, three or more terminal fittings may be mounted in one terminal holding member. In this case, plural pairs of terminal fittings connected to plural twisted pair cables may be mounted in one terminal holding member.

Although two terminal fittings are connected to the twisted pair cable in the above embodiment, the terminal fittings may be connected to wires having no noise countermeasure.

The guide rib and the auxiliary rib are formed on only one of the left and right side surfaces of the terminal unit in the above embodiment. However, the guide rib and the auxiliary rib may be formed on each of the left and right outer side surfaces of the terminal unit.

Although the guide rib and the auxiliary rib are disposed at the same height in the above embodiment, the guide rib and the auxiliary rib may be arranged at different heights.

Although the guide rib and the auxiliary rib are formed on the outer side surface of the terminal unit in the above embodiment, at least one of the guide rib and the auxiliary rib may be formed on the bottom surface (surface facing the retainer) of the terminal unit.

LIST OF REFERENCE SIGNS

10 . . . housing
10F . . . front end surface of housing
11 . . . accommodating portion
12 . . . window
13 . . . guide groove
16 . . . front stop wall
20 . . . retainer
30 . . . terminal unit
30F . . . front end surface of terminal unit
31 . . . terminal holding member
46 . . . guide rib
47 . . . auxiliary rib
48 . . . butting portion
49 . . . terminal fitting

The invention claimed is:

1. A connector, comprising:

a housing extending in forward and backward directions and formed with an accommodating portion inside, a front stop wall formed on a front end part of the accommodating portion and constituting a front end surface of the housing, the front stop wall having a rear-facing surface facing the accommodating portion and a front-facing surface opposite the rear-facing surface, and at least one window formed in the front stop wall and extending between the front-facing surface and the rear-facing surface to be open to the accommodating portion;

a guide groove formed in the accommodating portion;

a terminal unit configured by accommodating terminal fittings into a terminal holding member, the terminal unit being configured to be inserted into the accommodating portion;

a guide rib formed on an outer surface of the terminal unit, the guide rib being configured to guide the terminal unit in an inserting process into the accommodating portion by fitting to and sliding in contact with the guide groove;

a butting portion formed on the terminal unit at a position to come into contact with the rear-facing surface of the front stop wall; and a retainer configured to restrict outward detachment of the terminal unit from the accommodating portion by being mounted into the housing and locking the guide rib, wherein a front end part of the terminal unit extends into the window from behind to a position forward of the rear-facing surface of the front stop wall.

2. The connector of claim 1, comprising an auxiliary rib on an outer surface of the terminal holding member and at a position behind the guide rib in an inserting direction of the terminal unit, the auxiliary rib being configured for sliding in contact with the guide groove.

3. The connector of claim 1, wherein a front end surface of the terminal unit is positioned to be substantially flush with the front end surface of the housing with the terminal unit properly inserted in the accommodating portion.

* * * * *